US006061993A

United States Patent [19]

Bendixen et al.

[11] Patent Number: 6,061,993

[45] Date of Patent: May 16, 2000

[54] CONSTRUCTION MODULE, METHOD FOR PRODUCING SUCH MODULES AND THE USE OF THE MODULE

[75] Inventors: Christian Bendixen, Snarøya; Arne Gerhardsen, Mysen, both of Norway

[73] Assignee: Safety Rail System AS, Mysen, Norway

[21] Appl. No.: 09/051,577

[22] PCT Filed: Oct. 11, 1996

[86] PCT No.: PCT/NO96/00239

§ 371 Date: Sep. 25, 1998

§ 102(e) Date: Sep. 25, 1998

[87] PCT Pub. No.: WO97/13937

PCT Pub. Date: Apr. 17, 1997

[30] Foreign Application Priority Data

Oct. 13, 1995 [NO] Norway ..... 954085

[51] Int. Cl.[7] ..... A47B 13/08

[52] U.S. Cl. ..... 52/783.19; 52/232; 52/309.9; 52/783.11; 52/783.17; 52/784.12; 52/784.14; 52/793.1; 52/798.1; 428/117; 428/118; 428/304.4; 428/920

[58] Field of Search ..... 52/783.11, 783.17, 52/783.19, 784.12, 784.14, 793.1, 793.11, 798.1, 309.6, 232, 309.9; 428/116, 304.4, 318.4, 319.1, 117, 118, 920

[56] References Cited

U.S. PATENT DOCUMENTS

| | | | |
|---|---|---|---|
| 2,876,053 | 3/1959 | Eves | 52/787.1 |
| 3,819,466 | 6/1974 | Winfield et al. | 52/783.17 X |
| 3,895,152 | 7/1975 | Carlson et al. | 428/116 |
| 4,167,598 | 9/1979 | Logan et al. | 428/35 |
| 4,557,961 | 12/1985 | Gorges . | |
| 4,593,449 | 6/1986 | Meray-Hovarth et al. | 52/793.1 X |
| 4,596,730 | 6/1986 | Klingelhofer | 428/73 |
| 4,695,495 | 9/1987 | Ault | 428/73 |
| 4,822,661 | 4/1989 | Battalia | 428/116 |
| 4,931,340 | 6/1990 | Baba et al. . | |
| 5,117,596 | 6/1992 | Leslie et al. . | |
| 5,124,191 | 6/1992 | Seksaria | 428/178 |
| 5,273,806 | 12/1993 | Lockshaw et al. | 52/793.1 X |
| 5,399,406 | 3/1995 | Matsuo et al. | 428/57 |
| 5,635,306 | 6/1997 | Minamida | 52/793.1 X |
| 5,735,098 | 4/1998 | Kanai et al. | 52/508 |

FOREIGN PATENT DOCUMENTS

| | | |
|---|---|---|
| 4301565 | 7/1994 | Germany . |
| 2039923 | 2/1990 | Japan . |
| 2155638 | 6/1990 | Japan . |
| 5222784 | 8/1993 | Japan . |
| 7904099 | 10/1983 | Sweden . |
| 7907275 | 10/1983 | Sweden . |
| 1327232 | 8/1973 | United Kingdom . |

*Primary Examiner*—Carl D. Friedman
*Assistant Examiner*—Yvonne M. Horton
*Attorney, Agent, or Firm*—Townsend and Townsend and Crew LLP

[57] ABSTRACT

A module especially intended for being laid on floors, and possibly also walls or ceilings, is provided. The module comprises a base plate of a cellular light weight material and a fire proof cover plate. The underside of the cover plate is permanently connected to a lateral surface of the base plate using an intermediate bonding material. The module includes two elements, the base plate and one cover plate that comprises a wooden material, such as a hardwood. The elements are assembled to form a flat unit in a plank or parquet patten. The plate is of a thickness between 2 and 6 millimeters and is impregnated with a fire retardant agent. The other lateral surface of the base plate is uncovered, with the reverse surface of the base plate being free.

7 Claims, 1 Drawing Sheet

CONSTRUCTION MODULE, METHOD FOR PRODUCING SUCH MODULES AND THE USE OF THE MODULE

FIELD OF THE INVENTION

The invention concerns a construction module comprising a fire proof cover plate and a base plate of a cellular light weight material. The invention also relates to a method for producing such modules and the use of the module. A module of this type is known from U.S. Pat. No. 4,557,961, corresponding to WO-84/04727. The present invention is especially developed with a view to its being used for laying floors on board ships and other areas with a large floor space, but will also be able to be used in practically all environments and thereby also in connection with both ceiling and wall spaces.

BACKGROUND OF THE INVENTION

When surfaces are covered, after smoothing a coating is normally affixed to a base surface, or panel plates or other plates can be attached to battens for covering. Where floors are concerned it will be essential to have a flat surface on which boards, planks or, e.g. parquet blocks are laid in a certain pattern, which have to be glued or affixed to one another in order to provide a continuous surface. In order to provide it with sufficient rigidity, these planks or boards will have to be relatively thick and when hard wood is employed this will also entail a relatively large weight load on the base.

Particularly in connection with public places such as in assembly halls, but especially also on board ships, there are increasingly stringent requirements for the use of fireproof materials. This also applies to floor materials and other coverings. At the same time on board ships, for example, there is a desire to use wooden floors, both from traditional as well as practical and decorative considerations. On ships and other means of transport, however, weight is also important and a solid wooden floor implies a major weight load.

In connection with fitting out aircraft, where weight is also a crucial consideration, a panel has been developed with a metal core in the form of an open cell structure, a so-called waffle structure, on which by means of adhesive films on both sides of the metal structure there are affixed thin cover plates, which are preferably impregnated with a fire-retardant agent. These are regular cover plates or panels intended for mounting by conventional means. A panel of this type is described in the above mentioned WO-84/04727, corresponding to U.S. Pat. No. 4,557,961. Similar panel types are also described in SE 429988 and SE 430180.

SUMMARY OF THE INVENTION

The object of the present invention is to provide a module, a method for production thereof and use thereof, the module permitting surfaces to be constructed in a simplified manner compared to conventional laying or construction methods, while at the same time permitting a rationalization of the manufacture, thus enabling a surface to be completed in a substantially shorter time than by conventional means. A second object of the invention is to produce a module of the lightweight type which simplifies the manufacture of the completed surfaces, thus enabling the work to be performed in a shorter time and at a lower cost.

These objects are achieved with a module, a method and a mode of application which are characterized by the features presented in the patent claims.

By means of the invention, for example, a weight saving of up to ⅔ of the weight for a conventional wooden floor constructed from a hard wood can be achieved in the construction of ship's floors or decks. By means of the invention prefabricated modules are obtained, with which relatively large surface units which are connected can be laid at the same time. The construction of the modules can be arranged so as to provide the maximum size possible in order to enter the room through suitable openings. Due to the basic element of cellular light metal, the element will have an inherent rigidity, thus enabling large surface modules to be transported and the form of construction results in a weight which is so low that transport does not represent a problem.

Since the module's rigidity is provided by the light metal structure, a very thin cover structure of a fireproof material will suffice, e.g. with a wooden structure, or, as preferred by a wooden material suitable for the purpose. A special design according to the invention permits a wooden material of this kind to be very thin, with a thickness in the order of 2–6 mm. By using wood of this order of thickness it will be possible to use suitable methods for through-impregnating the wood so that in practice it will be non-inflammable. Such treatment will not be possible with conventional floor planks. A lightweight floor or other panel is thereby obtained which is both light in weight, fast and simple to install and in addition is fireproof. Due to their lack of inherent rigidity such thin plates will be difficult to employ on their own.

BRIEF DESCRIPTION OF THE DRAWINGS

The invention will now be explained in more detail by means of an embodiment which is illustrated in the drawing, in which.

DESCRIPTION OF THE SPECIFIC EMBODIMENTS

Figure 1:
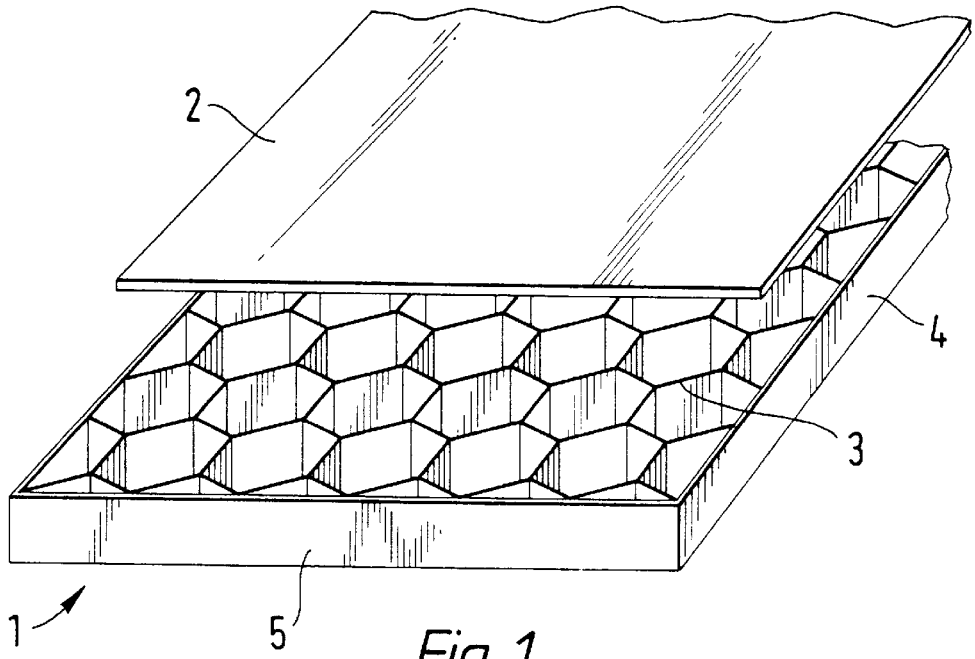
FIG. 1 a perspective view illustrating a module according to the invention with basic element an cover layer at a distance from each other, FIG. 2 a section through a floor produced according to the invention, and FIG. 3 a cut-away section of a module according to the invention with reference to a special embodiment.

In the drawing the invention is illustrated by an embodiment of a module according to the invention intended for the construction of a ship's floor. It should be noted that a similar construction will also be employed in connection with modules for floor or ceiling elements. The module consists of a basic element or a base plate which is generally designated by 1 and a cover plate 2 which can be composed of thin boards or planks or also of parquet blocks. These blocks or planks are combined to form a surface element in the conventional manner and this technique is therefore not described in more detail here. The basic element 1 and the cover plate 2 will have the same dimension. The thickness of the cover plates is in the order of 2–6 mm and they should be made of a fireproof material. For this purpose a plate of fireproof material with a wooden structure may be used, or as preferred according to the invention, it can be made of a hard wood of the type which is normally used for flooring. Before being assembled the wood is deeply impregnated with a fire-retardant material, e.g. a phenolic resin. Since plates are used with a thickness which does not exceed approximately 6 mm, it will be possible to obtain a complete impregnation of the plate, thus ensuring that it is fully fireproofed.

The base plates 1 are composed of a light metal plate with a cellular structure. The most commonly used for this purpose is a waffle-patterned cellular structure with vertical cells which are open at the top and downwards. In the drawing the cells are designated by 3. The base plate is preferably rectangular in shape and is terminated by lateral edge pieces 4 and 5. In the example illustrated, the aluminium basic element is connected to the cover plate 2 by means of an intermediate layer 7 of epoxy, which may be applied to the plate on the underside before being pressed on to the base plate 1, whereupon the epoxy layer is allowed to harden and bond the two plates together in a secure fashion.

Figure 2:
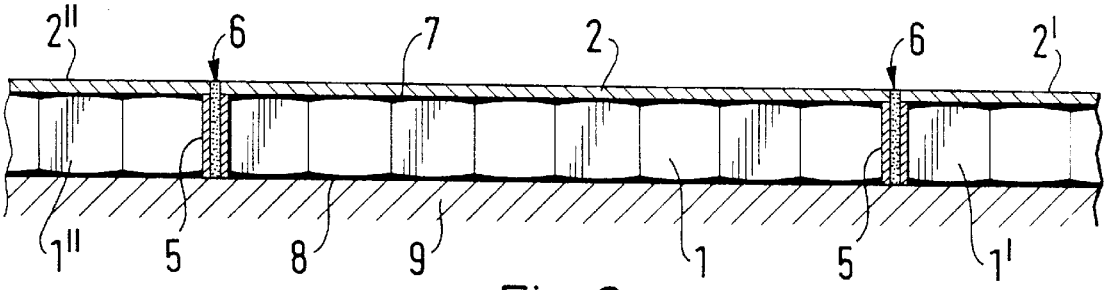

FIG. 2 illustrates how the gluing is performed and how a floor is constructed by means of modules according to the invention. When the floor is laid a layer of epoxy is spread over the surface of the floor or the base as designated by 9 in FIG. 2. This epoxy layer is designated by 8. The light metal plate is then pressed down on to this epoxy later 8, thus causing the profile edges of the waffle-patterned profile to penetrate the epoxy later 8, establishing a secure connection. Similar adjacent modules 1', 2' and 1", 2" are placed close against one another after the application of a intermediate layer 6 of epoxy. In this manner a floor can be glued rapidly and efficiently and be complete after the epoxy has hardened. Joints between the plates are also sealed with epoxy in the region of the reference numeral 6. The modules are prefabricated and transported to the laying location, since they can be prefabricated in a size which is adapted to the size of the room and the modules can be transported into the room where the floor has to be laid. A minimum number of elements are thereby used, which also means that the method can be implemented very rapidly.

Figure 3:
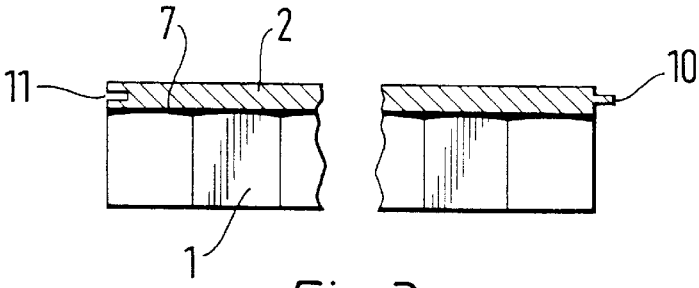

In FIG. 3 a second embodiment is illustrated in which the modules are joined together by means of a tongue and groove connection 10, 11. In this manner a continuous wooden floor can be constructed, with all the properties of the wooden floor while at the same time a certain degree of smoothing is obtained by the pressing of the floor plates down into the epoxy layer 8. The floor will also have some degree of pliability due to its construction and provide air insulation against the base. If so desired, the cavities in the cellular structure can also be filled with an insulating material such as glass wool, phenol-treated glass fiber, mineral wool, etc.

The same laying procedure can also be employed in connection with walls or ceilings. Modules can be specially manufactured in moulds on the basis of the contour of the surface, thus enabling completed areas of lightweight covering to be made in a substantially shorter time than by conventional methods. Many modification will be possible within the scope of the invention, particularly with regard to the module's size and the choice of materials.

In the above a module production method is described in which surfaces are coated with epoxy, but it should be obvious that the gluing technique can also be performed in another way. Instead of epoxy, polyurethane, for example, may also be employed, or other bonding materials such as fire-based two-component plastics, etc. The materials can be applied in layers, only in the areas which come into contact with the base plate, or they can be applied to the lateral surface of the base plate which is brought into contact with the plate. Pure adhesive components can also be used here, such as quick-setting glue or double-sided adhesive tape. These embodiments are not illustrated and will be able to be employed by a person skilled in the art. The attachment or moulding of the modules to the base can be performed in a suitable manner. Moulding in epoxy has been mentioned, but other materials are also conceivable. It is also possible to achieve a clean gluing process, provided the base has been smoothed.

What is claimed is:

1. A module, especially intended for being laid on floors, walls or ceilings, comprising a base plate of a cellular light weight material and a fire proof cover plate, an underside of which is permanently connected to a lateral surface of the base plate by means of an intermediate bonding material characterized in that the module consists of two elements, the base plate and one cover plate consisting of elements of a wooden material, wherein the elements are assembled to form a flat unit in a certain pattern, being of a thickness between two and six millimeters and impregnated completely through with a fire retardant agent, and that another lateral surface of the base plate is uncovered, with a reverse surface of the base plate being free.

2. A module according to claim 1, characterized in that the bonding material is an epoxy resin, polyurethane or another suitable bonding material.

3. A module according to claim 1, characterized in that the modules are equipped with edge faces and are preferably rectangular in shape.

4. A module as indicated in claim 1, characterized in that the base plate's cavity is filled with an insulating material such as glass wool, phenol-treated glass fiber or mineral wool.

5. A method for producing modules, especially intended for being laid on floors, walls or ceilings, wherein a cover plate of a fire proof material and a base plate of a cellular light weight material both are cut into a shape and size which are adapted to the location where it is to be used and bonded together with an adhesive characterized in that a cover plate of a wooden material consisting of elements provided in a certain pattern as a flat unit, with a thickness of 2–6 millimeters, which plate previously has been made fire proof through complete impregnation with a fire retardant agent, is connected to the cellular material by applying a layer of a bonding agent on a back of the plate or a lateral face of the base plate, where upon the plates are pressed together and bonded by the layer, which is then allowed to harden, leaving the other surface of the base plate free.

6. The use of a module according to claim 1 for the construction of a modular floor where the modules with their uncovered face are glued to the surface of the floor.

7. A module comprising:

a base plate comprising a cellular light weight material;

a fire proof cover plate having an underside which is permanently connected to a lateral surface of the base plate by an intermediate bonding material;

wherein the cover plate further comprises a wooden material having a thickness between 2 and 6 millimeters and impregnated completely through with a fire retardant agent, and wherein a surface of the base plate which is opposite to the surface of the base plate to which the cover plate is covered is uncovered so as to be free.

* * * * *